United States Patent [19]

Georges

[11] 4,244,283

[45] Jan. 13, 1981

[54] FRUIT AND LIKE TRANSPORTATION BINS

[75] Inventor: Richard P. Georges, Winter Haven, Fla.

[73] Assignee: Georges Enterprises, Inc., Winter Haven, Fla.

[21] Appl. No.: 34,661

[22] Filed: Apr. 30, 1979

[51] Int. Cl.[3] ..... A01F 25/00

[52] U.S. Cl. ..... 98/56; 220/84; 220/401

[58] Field of Search ..... 220/84, 401, 404; 4/116, 146, 175; 98/56

[56] References Cited

U.S. PATENT DOCUMENTS

| | | | |
|---|---|---|---|
| 1,651,443 | 12/1927 | Castanien | 4/175 |
| 2,765,542 | 10/1956 | Collins et al. | 98/56 |
| 3,050,073 | 8/1962 | McMillan | 220/401 |
| 3,337,086 | 8/1967 | Jenks | 220/404 |
| 3,342,368 | 9/1967 | Matry | 220/401 |
| 3,827,086 | 8/1974 | Seymour et al. | 4/175 |

*Primary Examiner*—Ronald C. Capossela

*Attorney, Agent, or Firm*—Le Blanc, Nolan, Shur & Nies

[57] ABSTRACT

A bin for the transportation of citrus fruit comprises a rigid fabricated frame having a substantially continuous top rim and an integral shape retaining tub of molded synthetic plastic mounted within and attached to the frame with the upper edges of the tub extending around substantially coextensively within the rim. The tub retains its shape even with a full load of fruit and has a bottom wall formed with an intermediate upstanding conical portion that is provided with perforations for promoting aeration of the fruit in the bin.

10 Claims, 4 Drawing Figures

FRUIT AND LIKE TRANSPORTATION BINS

This invention relates to fruit and like transportation bins, particularly to relatively large capacity bins of this type that may carry heavy loose loads of fruit such as oranges or grapefruit and may be subject to rough handling.

In its preferred embodiment the invention is directed to relatively large citrus fruit transportation bins of the type that are usually filled with fruit picked at the orchard and are then trucked in groups to a building where the individual bins are handled to dump the fruit on conveyors that carry it into and through cleaning, sorting, polishing and other treatments and eventually packing stations.

These bins are generally rectangular open top box-like devices, a representative size bin being about 45 inches wide, 45 inches long and 26 inches deep.

Prior to the invention these bins were made of wood, with flat interior surfaces merging at the corners into filler blocks or structures to provide rounded internal surfaces for reducing fruit damage. These corner blocks are also needed for structural strength. The flat wooden bottoms were slotted for aeration. Each bin may contain about 900 pounds of citrus fruit, and under present practice the filled bins are stacked three high on special truck bodies for transport to the treatment building. After the treatment building the bins are separated, lifted and turned over for dumping by forklift type machinery.

As a result of the extensive handling the wooden bins become damaged, and sometimes the interior surfaces are splintered, warped or otherwise deformed so that fruit damage may be avoidable. Wood may rot and life of a wooden bin is only a few years.

In the present invention the wooden bins are replaced by composite structure bins that comprise essentially integral tubs of synthetic plastic material mounted in rigid, preferably metal, frames; and this is the major object of invention.

A specific object of invention is to provide a novel fruit transportation bin wherein substantially all of the fruit contacting surfaces are smooth continuations of an integral molded plastic tub or like container secured within a protecting and carrying metal frame that may preferably be a prewelded structure.

A further object of invention is to provide a novel fruit transportation bin wherein an integral molded plastic tub or like container is suspended within a rigid metal frame.

Another object of the invention is to provide a novel integral tub-like structure of molded plastic adapted to provide the fruit contacting surfaces of a fruit transportation bin.

It is a further object of the invention to provide a novel fruit transportation bin wherein an integral molded plastic tub-like inner liner component is disposed within a rigid prefabricated metal frame, with the upper side edges of the liner component being secured to the frame so as to effectively suspend the component in the frame.

A further object of the invention is to provide a novel fruit transportation bin component that is an open top tub-like molded plastic member wherein the inner surfaces are smooth and substantially vertical at the sides; all side walls and the bottom wall are joined by internally rounded corner surfaces, and the bottom wall is formed with a conical or like upstanding formation that is preferably about centrally located for aiding fruit distribution during loading. Pursuant to this object, in the said formation and preferably at the rounded junctures between the bottom and side wall surfaces, aeration apertures are provided.

Further novel features and other objects of this invention will become apparent from the following detailed description, discussion and the appended claims taken in conjunction with the accompanying drawings.

PREFERRED EMBODIMENTS

Figure 1:
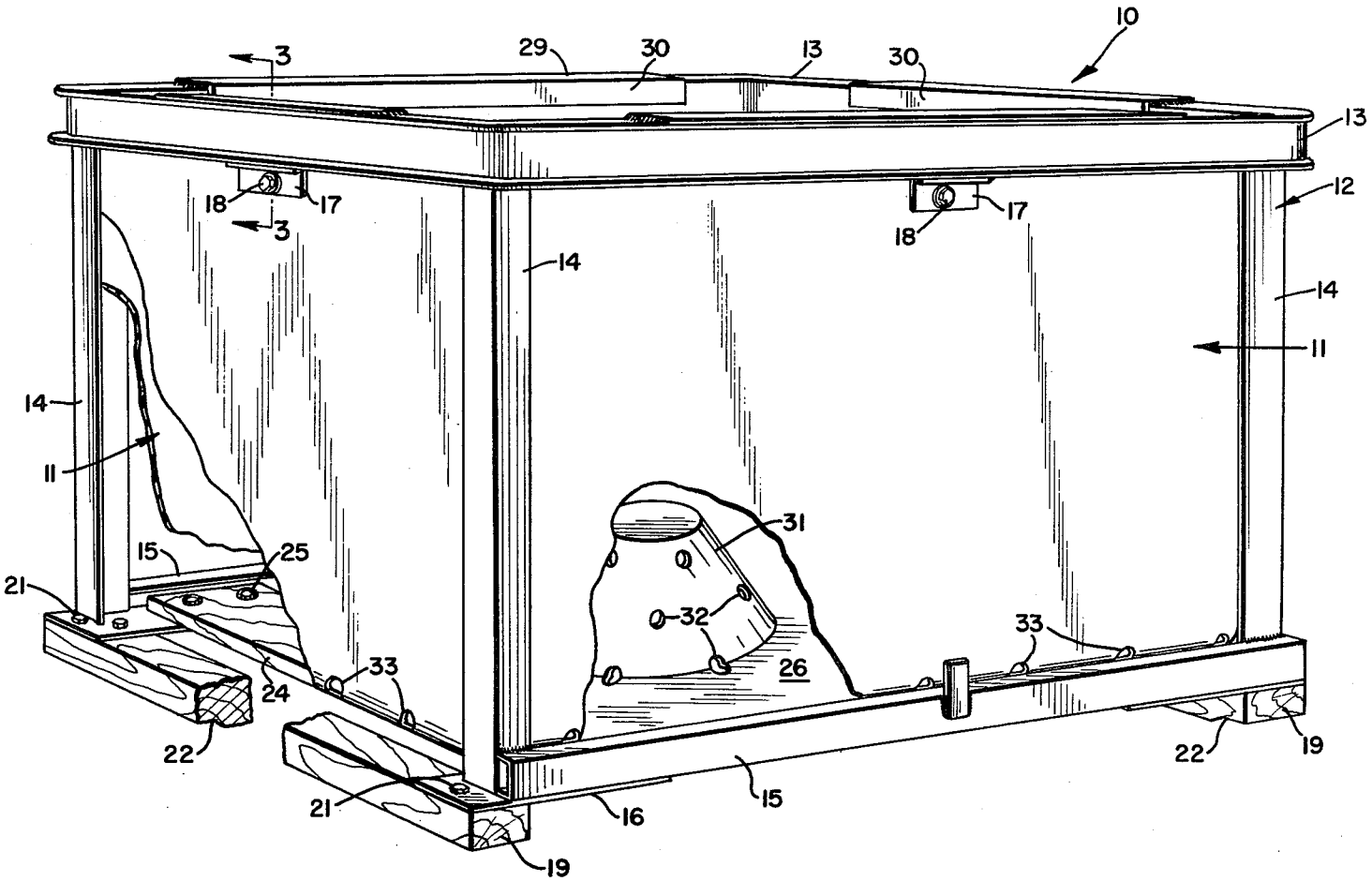
FIG. 1 is a generally perspective view, partly cut away and sectioned, illustrating the invention in a preferred embodiment.

The fruit transporter bin 10 of the invention is a composite structure consisting essentially of a one-piece molded synthetic plastic tub 11 mounted on a fabricated mainly metal frame 12. The tub and frame are preferably separately made and then assembled to final relation. If the tub is damaged or otherwise undesirably deformed or ruptured during use, it may be readily replaced in the frame by another from inventory as will appear. This reduces the need for maintaining complete bin units in stock.

Frame 12 is preferably a structural steel unit made of welded components of suitable alloy steel. The upper open end rim of the frame is defined by a continuous rigid channel member 13. This may be formed by bending and welding end to end one or more channel components. The shape of rim 13 is usually rectangular, preferably about square, with suitably rounded corners.

Four legs 14 of equal length depend in parallel relation from the four corners of rim 13. The upper ends of these legs which in practice are preferably angle irons are welded to rim 13.

Two box girders 15 extend between and are welded to the lower ends of legs 14 at two opposite sides of the frame. Girders 15 are parallel and preferably externally disposed.

At the lower end of each leg 14, a flat metal gusset plate 16 underlies the leg and an adjacent part of girder 15, preferably being welded thereto.

Figure 3:
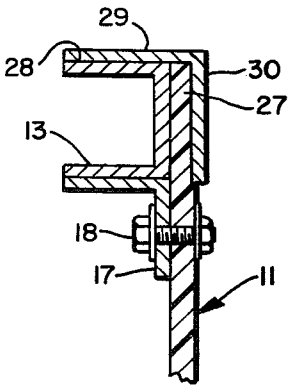
FIG. 3 is a fragmentary section substantially on line 3—3 of FIG. 1.
Figure 2:
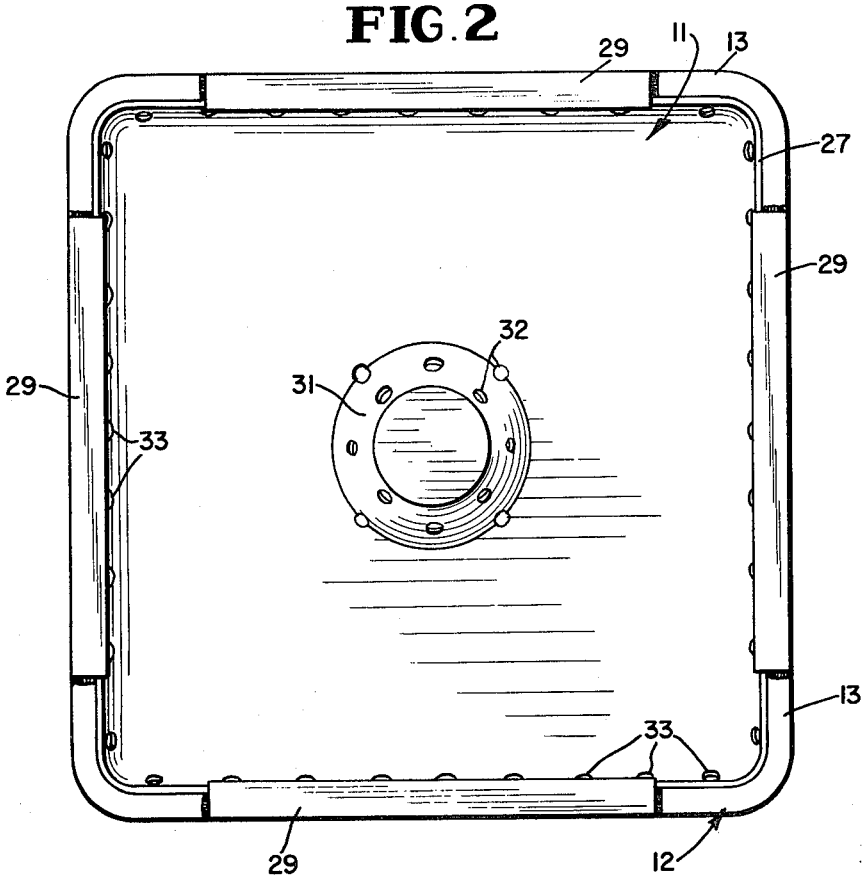
FIG. 2 is a top plan view.
Figure 4:
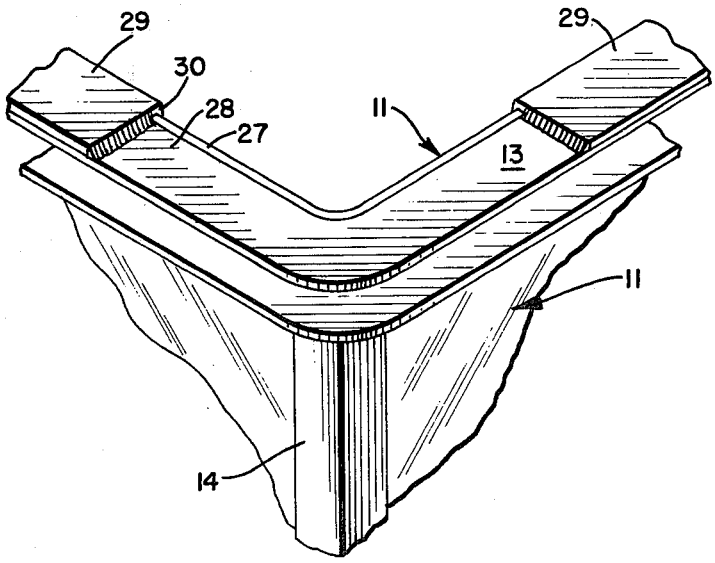
FIG. 4 is a fragmentary view showing an upper corner in general perspective.

As shown in FIGS. 1 and 3, a short angle iron bracket 17 is secured as by welding to the lower edge of rim 13, about midway at each side of the frame. There are thus four of these brackets 17 welded to rim 13 and they carry bolt assemblies 18 the purposes of which will be explained.

A pair of parallel wooden beams 19 extend across the lower part of the frame underlying the gusset plates. Preferably these beams are longitudinally notched along their outer corners as at 22, for stacking interfit with other bins. As shown, preferably beams 19 extend across the sides of the frame not traversed by girders 15, and below the level of those girders.

As shown in FIG. 1 the gusset plates 16 are bridged by a pair of wooden boards 24, secured as by bolts 25. There are two of these boards, one adjacent and parallel to but above each beam 19 and they are preferably spaced apart the distance of the times of a standard forklift truck. These boards represent the portions of the bin engaged by the handling mechanism when the bins are lifted.

The foregoing frame structure is usually preassembled and ready for incorporation with the tub 11.

The tub 11 is an integral molded element. It is comprised of a moldable plastic material which is highly shape retaining and inert with respect to weather and moisture changes, but will have good tensile strength and not be brittle, so that it will not crack, shatter or locally deform as when the heavy fruit is dumped into it. Its outstanding desirable properties are resistant to stress cracking, ability to maintain shape even when loaded say with 900 pounds of oranges, and good non-abrasive surfaces in contact with the fruit.

The material currently found most suitable for tub 11 is a crosslinkable high density polyethylene powder which exhibits cross linking during the molding process in which it may be handled like any conventional high density polyethylene. This material which is commercially available under the tradename MARLEX CL-100 exhibits the following properties.

| | MARLEX CL-100 | | | | |
|---|---|---|---|---|---|
| | | ENGLISH | | METRIC | |
| PROPERTY* | ASTM | UNIT | VALUE | UNIT | VALUE |
| Density Crosslinked Molded Product | D1505 | lbs/ft$^3$ | 58.2 | gms/cc | 0.930–0.933 |
| ESCR, Condition A, $F_{50}$ | D1693 | h | >1000 | h | >1000 |
| Tensile Strength, Ultimate 2"(50.8mm) per min. | D638 Type IV | psi | 2600 | MPa | 17.9 |
| Elongation, At Break 2"(50.8mm) per min. | D638 Type IV | % | 450 | % | 450 |
| Vicat Softening Temperature | D1525 | °F. | ~240 | °C. | ~116 |
| Brittleness Temperature | D746 | °F. | <−180 | °C. | <−118 |
| Flexural Modulus | D790 | psi | 100,000 | MPa | 689 |

*Based on parts molded at 650° F. for 13 minutes

Other similar high density polyethylene powders such as MARLEX CL-50 which will cross link with MARLEX CL-100 may be used.

The molded tub 11 preferably has a uniform thickness wall, in a working form about ¼ inch thick. The four side walls are vertical and may even slightly taper inwardly to the generally horizontal bottom wall. All of the corners between the four side walls and the bottom wall 26 are gently and smoothly curved, concave inwardly, so as to have least abrasive or damaging contact with the fruit.

In each bin unit the tub is essentially suspended within the frame 12. As shown in FIG. 3 the upper edges of the tub side walls indicated at 27 terminate flush with the top surface 28 of frame rim 13. Four angle irons 29, each shorter than a side of the tub are mounted on the rim 13 as by welding at the upper legs, each with an inner leg 30 depending within the tub side wall for about the depth of the rim 13. These angle irons 29 thus exert a rather tight clamping fit confining and slightly compressing each tub side wall along about two-thirds of its length.

Additional fastening is accomplished by the bolt assemblies 18 passing through the brackets 17 and the tub wall, with suitable washers (FIG. 3) to distribute the forces at the edges in the tub wall apertures.

With the upper part of the tub clamped to the upper part of frame 12 in the foregoing manner, it is seen that the tub is essentially suspended within a protective supporting and carrying frame. The dimensions of the parts are such that the tub fits snugly within the frame with its bottom wall resting lightly, especially in the fruit loaded condition, on the boards 24. Since the tub is thus effectively suspended within a protective rigid frame the lower parts of the tub may be free to slightly displace as fruit is dumped in and the tub walls are mainly free of attachment devices that might cause localized strains or tears in the plastic.

It has been found greatly desirable to specially form the bottom wall of the tub to help distribution of fruit during filing and particularly for aeration of the fruit in the container.

In the preferred embodiment the central part of the bottom wall 26 is formed with a frusto-conical closed top raised portion 31, preferably approximately centered on wall 26. In a 26 inch deep tub the cone 31 may be about 12 inches high and 15 inches in diameter at its base. The portion 31 is provided with a plurality of randomly distributed aeration holes 32 some of which are located at the juncture of raised portion 31 with the bottom wall of the tub. Also a series of these aeration holes 33 are formed all around the rounded surface juncture between the tub bottom wall and the side walls arising from it. These holes 32, 33 are advantageously sized, in the case of oranges for example, about one inch in diameter, and that fact coupled with the aforementioned distribution ensures that the oranges dumped into the bin do not cover up the aeration holes.

Preferably the tub is colored black, by some inert pigment incorporated in the molded mix. This is particularly advantageous in Florida and like climates in that tub becomes more highly resistant to hot sun and ultraviolet rays that may tend to degrade the plastic, and thus longer life is attained.

The invention provides a bin that has considerably longer useful life than wooden bins. The fabricated metal frame is resistant to distortion during handling, and may be reused should the tub be damaged, thus effecting a considerable savings. The fruit contacts only non-abrasive surfaces. The tub itself is resistant to deformation, warping, cracking and other forces, and suspension of the tub in the frame ensures that impact forces delievered to the frame are lessened with respect to the tub.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a bin for the transportation of fruit or the like, means defining a rigid frame, and an integral molded synthetic plastic tub mounted on and protectively carried by and within said frame, said frame being a box-like structure having an open top defined by a generally horizontal continuous rim, and said tub having its upper edges fixedly secured along said rim.

2. In the bin defined in claim 1, said frame being a fabricated distortion resistant metal structure having a rigid top rim, and said tub having its upper edges substantially coextensive with and extending along the inner side of said rim and being substantially free of attachment to said frame below said rim.

3. In the bin defined in claim 2, said rim being a continuous metal member defining a generally rectangular open top for the frame, and said frame comprising four rigid vertical corner members secured as by welding to the corners of said rim and at least two rigid horizontal members each secured as by welding to the lower ends of two vertical members at opposite sides of the frame.

4. In the bin defined in claim 2, said means for securing the upper edges of the tub to said rim comprising clamping elements fixed to the rim and extending along the inner sides of the upper edges of said tub.

5. In the bin defined in claim 1, said tub having a generally horizontal bottom wall formed intermediate its edges with an upstanding portion provided with aeration openings.

6. In the bin defined in claim 5, said upstanding portion of the bottom wall being substantially conical.

7. A container tub adapted to be a component of a fruit or like transportation bin, said tub consisting of an integral molded synthetic plastic unit having a bottom wall and upstanding side walls, the internal surfaces of said tub being continuous, smooth and non-abrasive, and said bottom wall being formed with an intermediate upwardly projecting portion that is shaped to direct distribution of fruit being dumped into the tub and contains a plurality of aeration openings.

8. The container tub defined in claim 7, wherein said tub is made of high density polyethylene.

9. In a bin for the transportation of citrus fruit, means defining a rigid frame having a substantially continuous top rim and an integral tub-like container of molded synthetic plastic mounted within said frame with the upper edges of said container extending around substantially coextensively within the rim, and means for attaching the upper portions of the container side walls to said rim whereby the container is effectively suspended within the frame substantially free of attachment to the frame below said rim, said container being internally smooth surfaced and capable of substantially retaining its shape even with a full load of fruit and having a bottom wall formed with an intermediate upstanding portion that is provided with open perforations for promoting aeration of the fruit in the bin.

10. In the bin defined in claim 9, said means for attaching the container side walls to the rim comprising rigid elements secured along the rim and clamping the upper edges of the tub to said rim.

* * * * *